US010321750B2

(12) United States Patent
Solomon et al.

(10) Patent No.: US 10,321,750 B2
(45) Date of Patent: Jun. 18, 2019

(54) COMBINED FOLDABLE CHAIR AND STORAGE BACKPACK

(71) Applicant: Lido Holdings, Inc., Long Beach, NY (US)

(72) Inventors: Alex Solomon, Long Beach, NY (US); Zachary Solomon, Long Beach, NY (US); Jochen R. Schaepers, New York, NY (US); Adrian Candela, Long Island City, NY (US); Stuart H. Lee, Forest Hills, NY (US)

(73) Assignee: LIDO HOLDINGS, INC., Long Beach, NY (US)

( * ) Notice: Subject to any disclaimer, the term of this patent is extended or adjusted under 35 U.S.C. 154(b) by 0 days.

(21) Appl. No.: 15/982,436

(22) Filed: May 17, 2018

(65) Prior Publication Data

US 2018/0332953 A1 Nov. 22, 2018

Related U.S. Application Data

(60) Provisional application No. 62/507,472, filed on May 17, 2017.

(51) Int. Cl.

| | |
|---|---|
| ***A47C 13/00*** | (2006.01) |
| ***A47C 7/62*** | (2006.01) |
| ***A45F 4/02*** | (2006.01) |
| ***A47C 4/28*** | (2006.01) |
| ***A47C 4/20*** | (2006.01) |
| ***A47C 4/52*** | (2006.01) |

(52) U.S. Cl.

CPC ..... *A45F 4/02* (2013.01); *A47C 4/20* (2013.01); *A47C 4/28* (2013.01); *A47C 4/52* (2013.01); *A47C 7/62* (2013.01); *A47C 13/00* (2013.01); *A45F 2004/026* (2013.01)

(58) Field of Classification Search

CPC .... A45F 4/02; A47C 4/20; A47C 4/28; A47C 4/52; A47C 7/62

USPC ..... 297/39–40, 45, 51–54, 129, 188.04, 297/188.06, 188.07

See application file for complete search history.

(56) References Cited

U.S. PATENT DOCUMENTS

| | | | | |
|---|---|---|---|---|
| 1,944,335 A * | 1/1934 | Van Wyck | ..... | A47C 4/10 297/54 X |
| 2,199,185 A * | 4/1940 | Monasch | ..... | A47C 4/36 297/51 |
| 3,285,654 A * | 11/1966 | Cramer | ..... | A47C 4/48 297/129 X |
| 4,676,548 A * | 6/1987 | Bradbury | ..... | A45F 4/02 297/129 X |

(Continued)

*Primary Examiner* — Rodney B White

(74) *Attorney, Agent, or Firm* — Carter, DeLuca & Farrell LLP

(57) ABSTRACT

A combined foldable chair and backpack that is movable between and open configuration for a user to sit thereon, and a folded configuration for a user to carry, is provided. The combined foldable chair and backpack includes a frame assembly, a fabric coupled to the frame assembly, a shoulder strap coupled to either the frame assembly or the fabric, and a storage compartment coupled to either the frame assembly or the fabric. The frame assembly includes a seat frame, a back frame pivotally coupled to the seat frame via a hinge assembly, a front leg pivotally coupled to the seat frame by a hinge, and a rear leg pivotally coupled to the hinge assembly by a hinge.

20 Claims, 9 Drawing Sheets

(56) References Cited

U.S. PATENT DOCUMENTS 4,684,278 A * 8/1987 Rauschenberger ..... A47C 4/20 297/46 X
4,687,248 A * 8/1987 Ross ..... A47C 4/52 297/129 X
4,773,708 A * 9/1988 Nastu ..... A47C 1/143 297/17
4,889,383 A * 12/1989 Jones ..... A47C 4/02 297/54 X
4,894,877 A * 1/1990 Marsh ..... A47C 1/143 297/53 X
5,246,265 A * 9/1993 Nagan ..... A47C 3/38 297/54 X
5,356,160 A * 10/1994 Urlwin ..... A47C 7/002 297/129 X
5,529,375 A * 6/1996 English ..... A47C 1/124 297/40 X
5,588,696 A * 12/1996 Jay ..... A47C 1/0265 297/129 X
5,899,525 A * 5/1999 Tseng ..... A47D 1/02 297/51 X
5,911,478 A 6/1999 Goodman
5,921,621 A 7/1999 Cook et al.
5,927,812 A 7/1999 Vanderminden, Sr.
5,988,737 A * 11/1999 Tomaiuolo ..... A47C 4/52 297/129 X
6,012,769 A * 1/2000 Hsueh ..... A47C 3/16 297/54 X
6,036,262 A * 3/2000 Shahid ..... A47C 1/143 297/184.15
6,045,177 A 4/2000 Grace
6,056,172 A * 5/2000 Welsh ..... A45F 4/02 297/129 X
6,059,365 A 5/2000 Diamond
6,068,342 A 5/2000 Mariani et al.
6,079,777 A 6/2000 Simmons et al.
6,082,816 A 7/2000 Gottlieb et al.
6,145,716 A * 11/2000 Caicedo ..... A45F 3/04 297/129 X
6,231,119 B1 5/2001 Zheng
6,241,313 B1 6/2001 Lenz et al.
6,247,749 B1 6/2001 Yu
6,296,304 B1 10/2001 Zheng
6,322,138 B1 11/2001 Tang
6,364,409 B1 4/2002 Saul et al.
6,371,555 B1 4/2002 Edwards et al.
6,382,715 B1 5/2002 Tang
6,382,727 B1 5/2002 Pickard
6,402,231 B1 6/2002 Pedemonte
6,406,091 B1 6/2002 Saul et al.
6,494,538 B1 12/2002 Alvestad
6,527,343 B2 3/2003 Scheurer et al.
6,540,290 B2 4/2003 Liu
6,550,855 B2 4/2003 Liu
6,626,491 B1 9/2003 Blome et al.
6,634,705 B1 10/2003 Zheng
6,637,811 B2 10/2003 Zheng
6,644,731 B2 11/2003 Tang
6,698,827 B2 3/2004 Le Gette et al.
6,698,828 B1 * 3/2004 Chan ..... A47C 4/06 297/51
6,739,652 B2 5/2004 Welsh
6,764,132 B1 7/2004 Gaertner
6,783,181 B2 8/2004 Scheurer et al.
6,789,848 B2 9/2004 Rauschenberger et al.
6,814,403 B2 11/2004 Zheng
6,820,927 B2 11/2004 Isom et al.
6,926,355 B2 8/2005 Le Gette et al.
6,979,056 B1 12/2005 Goldszer
RE39,022 E 3/2006 Welsh
7,017,984 B2 3/2006 Chen
7,021,717 B2 4/2006 Gaylord et al.
7,118,172 B1 * 10/2006 Pattison-Sheets ..... A45F 4/02 297/129
7,178,863 B1 2/2007 Norval
7,182,401 B2 2/2007 Scheurer et al.
7,192,091 B1 3/2007 Ping Sheng
7,207,622 B2 4/2007 Cohan
7,281,767 B2 10/2007 Gaylord et al.
7,328,953 B2 * 2/2008 Werschmidt ..... A47K 3/125 297/51 X
7,374,247 B2 5/2008 Welsh et al.
D571,115 S 6/2008 Cohen
7,416,248 B2 8/2008 Rojas
7,431,389 B2 10/2008 Reeb et al.
7,438,355 B2 * 10/2008 Pedemonte ..... A47C 1/143 297/188.04 X
7,527,331 B2 5/2009 Fargason, III
7,549,706 B2 6/2009 Scheurer et al.
7,566,095 B2 7/2009 Reeb et al.
7,575,277 B2 8/2009 Habing
7,581,788 B1 9/2009 Johnson
7,628,450 B2 12/2009 Castagnola et al.
7,631,940 B1 12/2009 Jager
7,641,279 B1 1/2010 Curcio
7,644,981 B2 * 1/2010 Hensley ..... A47C 4/32 297/129
D612,624 S 3/2010 Lovley et al.
7,703,854 B2 4/2010 LaFreniere
7,717,514 B2 5/2010 Redmann
7,753,441 B1 7/2010 Gray, Jr.
7,775,587 B1 8/2010 Reed
7,815,254 B2 10/2010 Reeb et al.
7,823,968 B2 11/2010 Long et al.
7,832,804 B2 11/2010 LaFreniere
7,909,395 B2 3/2011 Reeb et al.
8,002,349 B1 8/2011 Pizzuto
8,042,865 B2 10/2011 Fargason, III
8,070,220 B2 12/2011 Reeb et al.
8,100,469 B2 1/2012 Lougee
8,100,475 B2 1/2012 Habing
8,123,290 B1 2/2012 Aiken et al.
8,141,944 B2 3/2012 Reeb et al.
8,167,374 B2 5/2012 Findlay
8,186,755 B2 5/2012 Lovley
8,197,000 B1 6/2012 Cohen
8,210,614 B2 7/2012 Shao
8,240,760 B2 8/2012 Scheurer et al.
8,251,442 B2 8/2012 Grace
8,276,984 B1 10/2012 Jamison, Jr.
8,292,362 B2 10/2012 Reeb et al.
8,297,695 B1 10/2012 Aiken et al.
RE43,847 E 12/2012 Le Gette et al.
8,322,784 B2 12/2012 Ayre et al.
8,371,653 B2 2/2013 Albecker, III
8,449,026 B1 5/2013 Gutierrez et al.
D683,550 S 6/2013 Ammann, Jr.
8,459,741 B2 6/2013 Mazzola et al.
8,465,090 B1 6/2013 O'Connor
D685,584 S 7/2013 Ammann, Jr.
8,511,747 B2 8/2013 Lougee
8,517,465 B2 8/2013 Reeb et al.
8,534,758 B2 9/2013 Rivera
8,567,860 B2 10/2013 Jue
8,573,454 B2 11/2013 Talavera Tolentino
8,585,135 B2 11/2013 Wilson
8,636,318 B2 1/2014 Newsome
8,668,268 B1 3/2014 Cormack
8,678,490 B2 3/2014 Chen
8,690,236 B2 4/2014 Gorinas et al.
8,690,247 B2 4/2014 Rivera
8,696,052 B2 4/2014 Zhu
8,702,166 B2 4/2014 Brunner
8,740,298 B2 6/2014 Kenttamaa-Squires et al.
8,789,884 B1 7/2014 Edelman et al.
8,801,091 B2 8/2014 Squires et al.
8,814,261 B2 8/2014 Chamberlain et al.
8,864,222 B2 10/2014 Grace
8,864,223 B2 10/2014 Larson et al.
8,894,139 B1 11/2014 Coffey
8,899,673 B2 12/2014 Holland
8,936,305 B1 1/2015 Skursky
RE45,417 E 3/2015 Smith

(56) References Cited

U.S. PATENT DOCUMENTS

| | | | |
|---|---|---|---|
| 8,979,184 | B2 | 3/2015 | Stafford et al. |
| 8,979,192 | B2 | 3/2015 | Miller |
| 8,991,915 | B1 | 3/2015 | Mittelsted |
| 9,039,077 | B1 | 5/2015 | Santamaria |
| 9,049,938 | B2 | 6/2015 | Reeb et al. |
| 9,060,611 | B2 | 6/2015 | Grace |
| 9,084,488 | B2 | 7/2015 | Rivera |
| 9,101,219 | B2 | 8/2015 | Smith |
| 9,108,549 | B2 | 8/2015 | Thurow |
| 9,113,701 | B2 | 8/2015 | Zhu |
| 9,173,500 | B2 | 11/2015 | Squires et al. |
| 9,185,982 | B2 | 11/2015 | Kilzer |
| 9,185,983 | B1 | 11/2015 | Cohen |
| 9,192,235 | B2 | 11/2015 | Horowitz |
| 9,204,725 | B2 | 12/2015 | Kania et al. |
| 9,204,729 | B2 | 12/2015 | Frankel et al. |
| 9,220,347 | B2 | 12/2015 | Lovley, II et al. |
| 9,226,581 | B2 | 1/2016 | Rivera |
| 9,247,817 | B2 | 2/2016 | Grace |
| 9,247,818 | B2 | 2/2016 | Shively |
| 9,254,044 | B2 | 2/2016 | Dudik |
| 9,271,576 | B2 | 3/2016 | Loney |
| 9,282,822 | B2 | 3/2016 | Hogue |
| 9,282,824 | B2 | 3/2016 | Grace |
| 9,307,840 | B2 | 4/2016 | Restrepo et al. |
| 9,332,849 | B2 | 5/2016 | Wagner et al. |
| 9,332,852 | B1 | 5/2016 | Milich et al. |
| 9,351,574 | B2 | 5/2016 | Lin |
| 9,351,581 | B1 | 5/2016 | Sawyer |
| 9,375,092 | B2 | 6/2016 | Edelman et al. |
| 9,408,473 | B2 | 8/2016 | Sabina |
| 9,468,297 | B2 | 10/2016 | Grace |
| 9,474,376 | B2 | 10/2016 | Drew |
| 9,538,840 | B2 | 1/2017 | Yang |
| 9,615,666 | B2 | 4/2017 | Milich et al. |
| 9,622,582 | B2 | 4/2017 | Lougee |
| 9,622,584 | B2 | 4/2017 | Eicke |
| 2007/0084891 | A1* | 4/2007 | Gillespie ..... A45F 4/02 224/155 |
| 2013/0214565 | A1* | 8/2013 | Nickell ..... A47C 1/143 297/30 |
| 2015/0366357 | A1* | 12/2015 | Nelson ..... A47C 1/14 297/129 |

* cited by examiner

COMBINED FOLDABLE CHAIR AND STORAGE BACKPACK

CROSS-REFERENCE TO RELATED APPLICATIONS

This application claims the benefit of, and priority to, U.S. Provisional Patent Application Ser. No. 62/507,472, filed on May 17, 2017, the entire contents of which are incorporated by reference herein.

BACKGROUND

Technical Field

The present disclosure relates to foldable chairs with storage containers, and more particularly, a reclinable foldable chair, with a storage container, that can be carried or worn on the shoulders of a user when the chair is folded.

Background of Related Art

Combined chair and backpack designs generally fall into one of two groups. The first group includes tent-like assemblies which utilize a generally scissor-like or X-shaped frame and a fabric coupled to the frame. When these chairs are stored, the frame closes to a planar position and the fabric seat is relaxed and folded between the frame members. The second group uses a parallelogram frame, in which the fabric chair seat is carried in its own frame and is always tensioned, regardless of whether the chair is in an open seating configuration or in a folded storage configuration.

When a user desires to carry the folded chair on his or her back, components of the folded chair often rest against undesired areas of the user's back and are generally uncomfortable to carry due to the unbalanced weight of the components of the chair or storage area when the chair is in the folded configuration. Additionally, while current chairs are foldable, include storage areas, and are wearable by a user, the current designs do not consider protecting the storage area of the chair when the chair is folded, thus leaving the storage area (and items stored therein) vulnerable to damage.

The instant disclosure provides for a foldable chair that addresses the above-noted shortcomings and others not specifically listed above.

SUMMARY

A combined foldable chair and backpack apparatus that is movable between and open configuration for a user to sit thereon, and a folded configuration for a user to carry, is provided. The combined foldable chair and backpack includes a frame assembly, a fabric coupled to the frame assembly, a shoulder strap coupled to either the frame assembly or the fabric, and a storage compartment coupled to either the frame assembly or the fabric. The frame assembly includes a seat frame, a back frame pivotally coupled to the seat frame via a hinge assembly, a front leg pivotally coupled to the seat frame by a hinge, and a rear leg pivotally coupled to the hinge assembly or another portion of the frame assembly by a hinge.

In an aspect, the frame assembly includes a left hinge assembly including a left seat finger, a left armrest finger, and a left back finger and a right hinge assembly including a right seat finger, a right armrest finger, and a right back finger. The seat frame includes a left side frame of the seat frame operably coupled to the left seat finger, a right side frame of the seat frame operably coupled to the right seat finger, a left armrest operably coupled to the left armrest finger, a right armrest operably coupled to the right armrest finger, a rear crossbar operably coupled to the right hinge assembly and the left hinge assembly, and a front crossbar operably coupled to at least one of the left armrest and the right armrest, the left side frame of the seat frame and the right side frame of the seat frame, or the left armrest, the right armrest, the left side frame of the seat frame and the right side frame of the seat frame.

In an aspect, the front leg is operably coupled to and extending from the left side frame of the seat frame and the right side frame of the seat frame such that the front leg is movable between an extended configuration, where the front leg is substantially perpendicular to a longitudinal axis X-X of the seat frame, and a stored configuration, where the front leg is substantially parallel to the longitudinal axis of the seat frame. Additionally, the rear leg is operably coupled to and extending from the left hinge assembly and the right hinge assembly such that the rear leg is movable between an extended configuration, where the rear leg is substantially perpendicular to the longitudinal axis of the seat frame, and a stored configuration, where the rear leg is substantially parallel to the longitudinal axis of the seat frame. In an aspect, the left hinge assembly is defined by a first housing half and a second housing half, a first half of the left seat finger extending from the first housing half and a second half of the left seat finger extending from the second housing half.

In an aspect, the back frame is operably coupled to and extending from the left back finger and the right back finger such that the back frame is movable between an extended configuration, where the back frame is substantially perpendicular to the longitudinal axis of the seat frame, and a folded configuration, where the back frame is substantially parallel to the longitudinal axis of the seat frame.

The fabric has a seat portion operably coupled to the seat frame and a back portion operably coupled to the back frame and configured to support the weight of a user seated thereon. In an aspect, shoulder straps are operably coupled to the seat portion of the fabric and the back portion of the fabric. Additionally, or alternatively, shoulder strap may be coupled to the front crossbar of the seat frame and the rear crossbar of the seat frame.

The frame assembly may include a left front leg hinge and a right front leg hinge pivotally coupling the front leg to the seat frame. In an aspect, the front leg forms a U-shape defined by a front leg left straight tube operably coupled to the left front leg hinge, a front leg left radial tube operably coupled to the front leg left straight tube, a front leg straight tube operably coupled to the front leg left radial tube, a front leg right radial tube operably coupled to the front leg straight tube, and a front leg right straight tube operably coupled to the front leg right radial tube and the right front leg hinge.

Additionally, or alternatively, the frame assembly may include a left rear leg hinge and a right rear leg hinge pivotally coupling the rear leg to the right hinge assembly. In an aspect, the rear leg forms a U-shape defined by a rear leg left straight tube operably coupled to the left rear leg hinge, a rear leg left radial tube operably coupled to the rear leg left straight tube, a rear leg straight tube operably coupled to the rear leg left radial tube, a rear leg right radial tube operably coupled to the rear leg straight tube, and a rear leg right straight tube operably coupled to the rear leg right radial tube and the right rear leg hinge.

In an aspect, an inner width of the rear leg is greater than an outer width of the front leg.

In an aspect, the front crossbar, the left armrest, and the right armrest are formed of a single tubular frame. Additionally, or alternatively, the left armrest and the right armrest may be surrounded by a padding material.

In an aspect, the left armrest includes a rear left straight tube operably coupled to a left armrest finger of the left hinge assembly, a rear left top radial tube operably coupled to the rear left straight tube, a left armrest straight tube operably coupled to the rear left top radial tube, a front left top radial tube operably coupled to the left armrest straight tube, a front left straight tube operably coupled to the front left top radial tube, and a front left bottom radial tube operably coupled to the front left straight tube and the front crossbar. Additionally, the right armrest includes a rear right straight tube operably coupled to a right armrest finger of the right hinge assembly, a rear right top radial tube operably coupled to the rear right straight tube, a right armrest straight tube operably coupled to the rear right top radial tube, a front right top radial tube operably coupled to the right armrest straight tube, a front right straight tube operably coupled to the front right top radial tube, and a front right bottom radial tube operably coupled to the front right straight tube and the front crossbar. The front left bottom radial tube is operably coupled to a proximal portion of the left side frame of the seat frame and the front right bottom radial tube is operably coupled to a proximal portion of the right side frame of the seat frame.

In an aspect, the back frame includes a back frame left straight tube operably coupled to a left back finger of the left hinge assembly, a back frame left radial tube operably coupled to the back frame left straight tube, a back frame straight tube operably coupled to the back frame left radial tube, a back frame right radial tube operably coupled to the back frame straight tube, and a back frame right straight tube operably coupled to the back frame right radial tube and the right back finger of the right hinge assembly.

A latch may extend from the front crossbar of the seat frame and is configured to secure the front crossbar to the back frame when the back frame is in the folded configuration.

A side table may be operably coupled to the seat portion of the fabric and the left armrest. The side table may be configured to move between a closed configuration, where the side table is folded inwardly toward the left armrest, and an open configuration, where the side table lays flat to support an object thereon. In an aspect, one end of the side table extends from the seat portion of the fabric and the other end of the side table is coupled to the left armrest by at least one strap. A retaining element may be provided to retain the side table in the closed configuration.

In an aspect, the fabric defines a proximal left seat loop coupled to a proximal portion of the left side frame of the seat frame, a distal left seat loop coupled to a distal portion of the left side frame of the seat frame, and a gap between the proximal seat loop and the distal seat loop.

The storage container may include a cooler pocket lined with insulative walls. A rigid case may be removably coupled to a portion of the storage compartment.

BRIEF DESCRIPTION OF THE DRAWINGS

Embodiments of the present disclosure are described herein with reference to the accompanying drawings, wherein.

DETAILED DESCRIPTION

Figure 1:
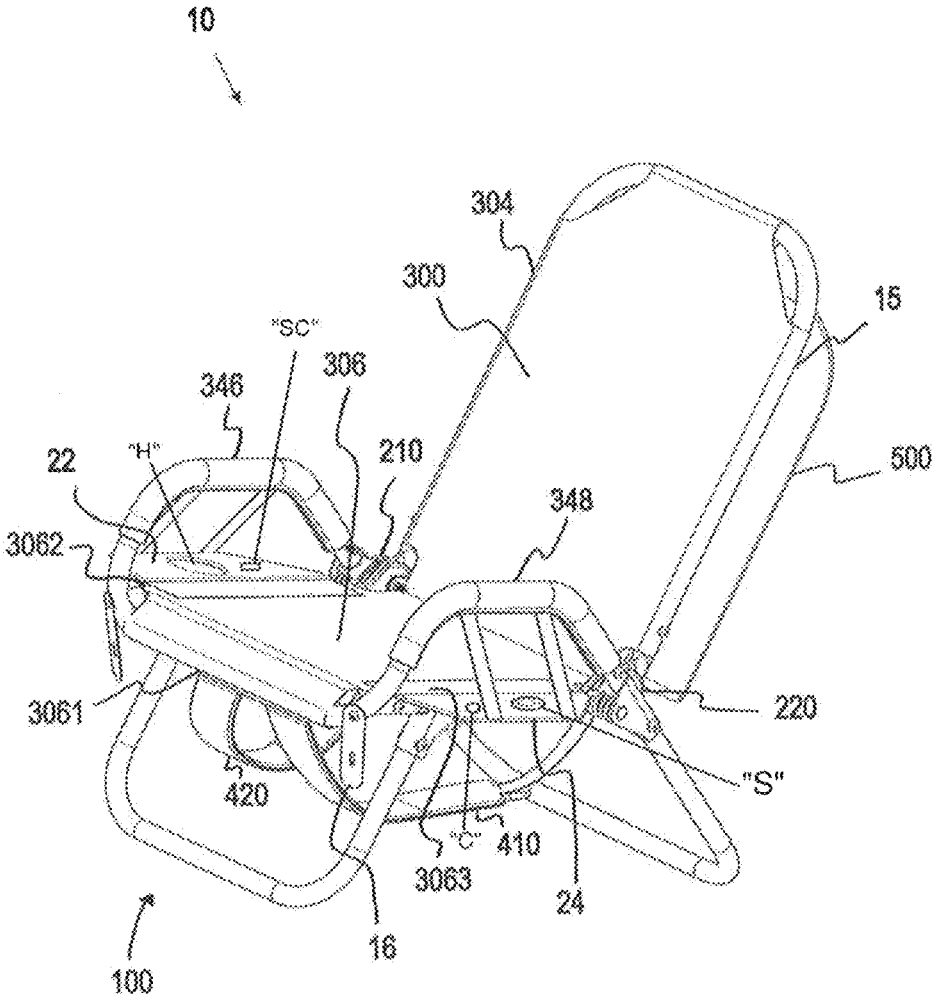
FIG. 1 is a perspective view of a combined foldable chair and storage backpack apparatus in accordance with the present disclosure.

Embodiments of the present disclosure are now described in detail with reference to the drawings in which like reference numerals designate identical or corresponding elements in each of the several views. Throughout this description, the term "proximal" or "front" refers to the portion of the chair apparatus or component thereof that is closest to a user when the chair apparatus is in the open, unfolded, configuration (for seating) and the term "distal," "back," or "rear" refers to the portion of the chair apparatus or component thereof that is farthest from the user when the chair apparatus is in the open, unfolded, configuration.

As will be described in detail below, provided is a combined foldable chair and storage backpack apparatus configured to transition from a reclinable chair for a user to be seated thereon to a portable wearable storage apparatus to be carried by a user and to store items therein. The chair apparatus includes a tubular frame having, for example, a series of interconnected tubes, a fabric attached to the tubes, and a hinge assembly, which together provide structural support for use as a chair with a seat and a reclinable back and for quick transition between a folded configuration for carrying the apparatus and an open configuration for sitting on the apparatus. Additionally, the chair apparatus of the instant disclosure includes a storage container that is protected and surrounded by components of the frame assembly when the chair is in the folded configuration. Additionally, the chair apparatus of the instant disclosure is comfortably worn by a user when in the folded configuration due to the balanced nature of the weight of its respective components and the regions defined by the components for storage of the remaining components.

A chair apparatus 10 includes a frame assembly 100, a fabric 300 coupled to the frame assembly 100 and configured to support the weight of a user seated thereon, a storage compartment 500 coupled to at least one of the frame assembly 100 or the fabric 300, and at least one shoulder strap 410, 420 coupled to at least one of the frame assembly 100 or the fabric 300 and extending therefrom. The chair apparatus 10 is configured to transition between an open configuration (FIG. 1 and FIG. 4), for a user to be seated thereon, and a folded configuration (FIG. 5), for a user to carry the chair apparatus 10. Additionally, a back portion of the chair apparatus 10 is coupled to the seat portion of the chair apparatus 10 by a left hinge assembly 210 and a right hinge assembly 220 and is configured to recline to multiple positions, each position being at a different angle relative to a longitudinal axis X-X (FIG. 4) of the seat portion.

The frame assembly 100 provides the structural support for the chair apparatus 10 and includes a front leg 110, a rear leg 120, a back frame 130, a seat frame 140, a left hinge assembly 210, and a right hinge assembly 220. Each of the front leg 110, rear leg 120, back frame 130, and seat frame 140 are shaped and defined by a series of interconnecting tubes, where each of the series of interconnecting tubes is either a straight (linear) tube or a curved (radial) tube. Each of the series of interconnecting tubes may be connected to one another by any suitable means. In one aspect, the interconnecting tubes are friction-fitted to each other, where one tube end has a diameter larger than a diameter of an adjacent tube end and the adjacent tube end is inserted into the larger diameter tube end. Additionally, or alternatively, the interconnecting tubes may be fastened to each other by way of a screw, nut and bolt, pop-up fastener, adhesive, corresponding interconnecting locking elements, or any combination thereof. Alternatively, some or all of the front leg 110, rear leg 120, back frame 130, and seat frame 140 may be formed of a single tubular structure bent at certain portions thereof to define the shape of the front leg 110, rear leg 120, back frame 130, and/or seat frame 140.

Figure 4:
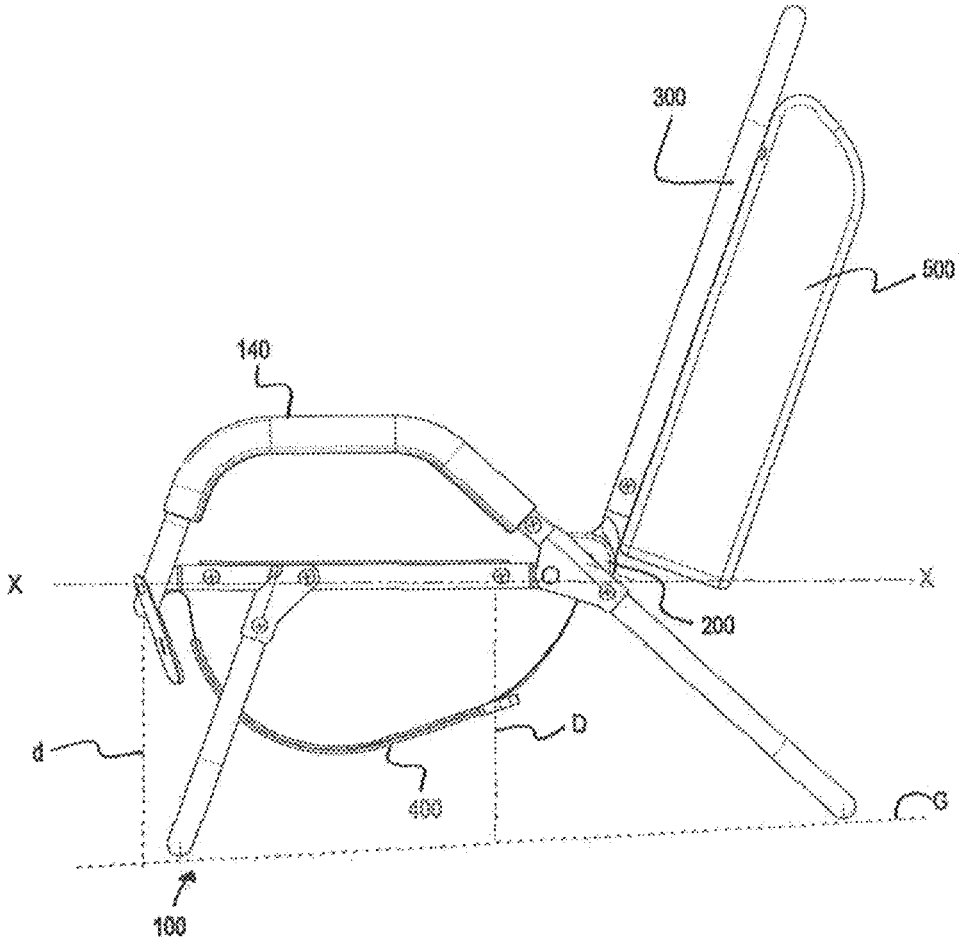
FIG. 4 is a left side view of the chair apparatus of FIG. 1 in an open configuration for a user to be seated on the chair apparatus.
Figure 5:
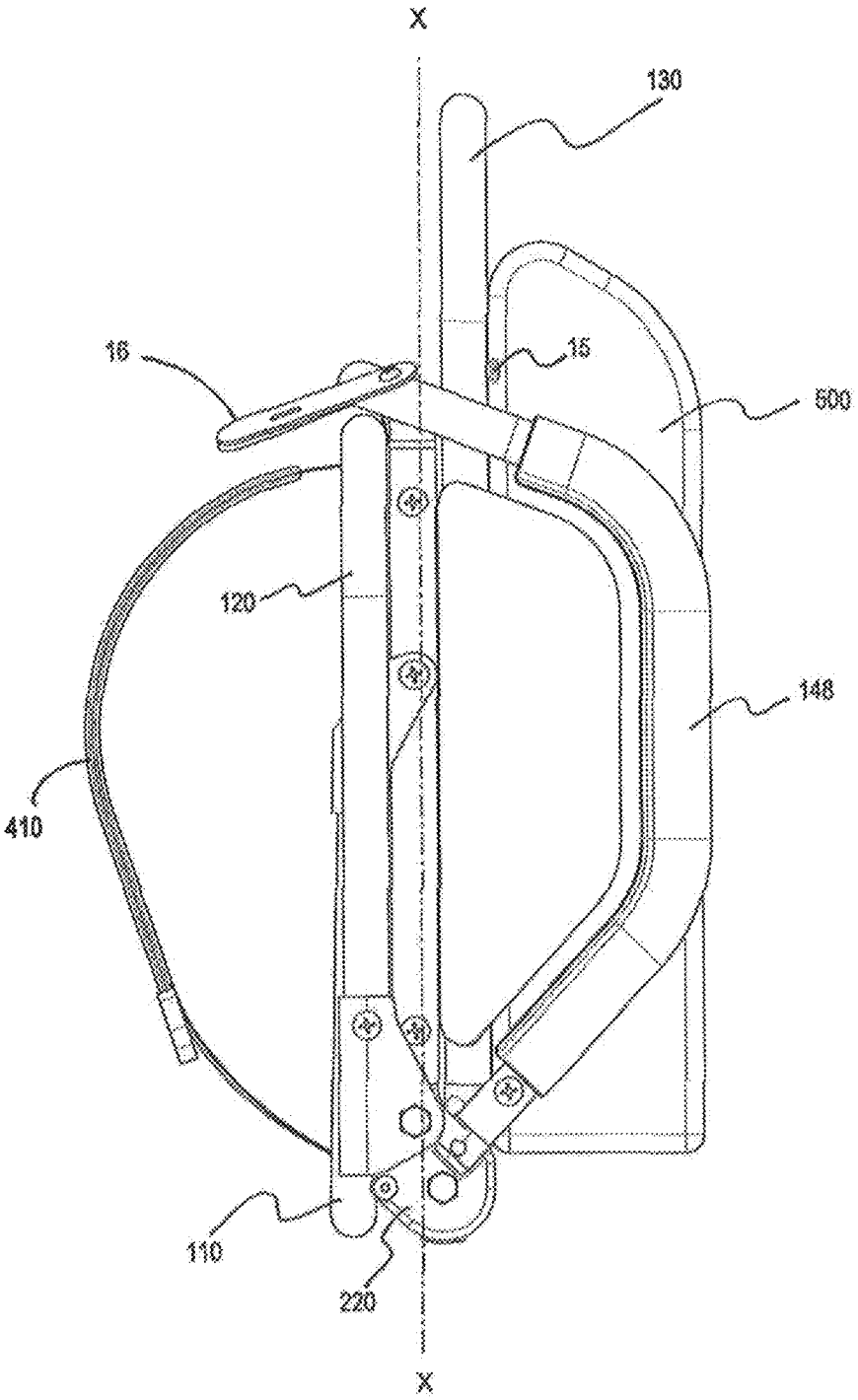
FIG. 5 is a left side view of the chair apparatus of FIG. 1 in a folded configuration for a user to carry the chair apparatus.

The seat frame 140 defines a longitudinal axis X-X (FIG. 4), and each of the front leg 110, the rear leg 120, and the back frame 130 are pivotable relative to the seat frame 140, to transition the chair apparatus 10 between the open configuration (FIG. 1 and FIG. 4) and the folded configuration (FIG. 5). As described in further detail below, the front leg 110 is pivotable relative to the seat frame 140 via left front leg hinge 182 and right front leg hinge 184, the rear leg 120 is pivotable relative to the seat frame 140 via left rear leg hinge 122 and right rear leg hinge 124, and the back frame 130 is pivotable relative to the seat frame 140 via the left hinge assembly 210 and the right hinge assembly 220.

Figure 2:
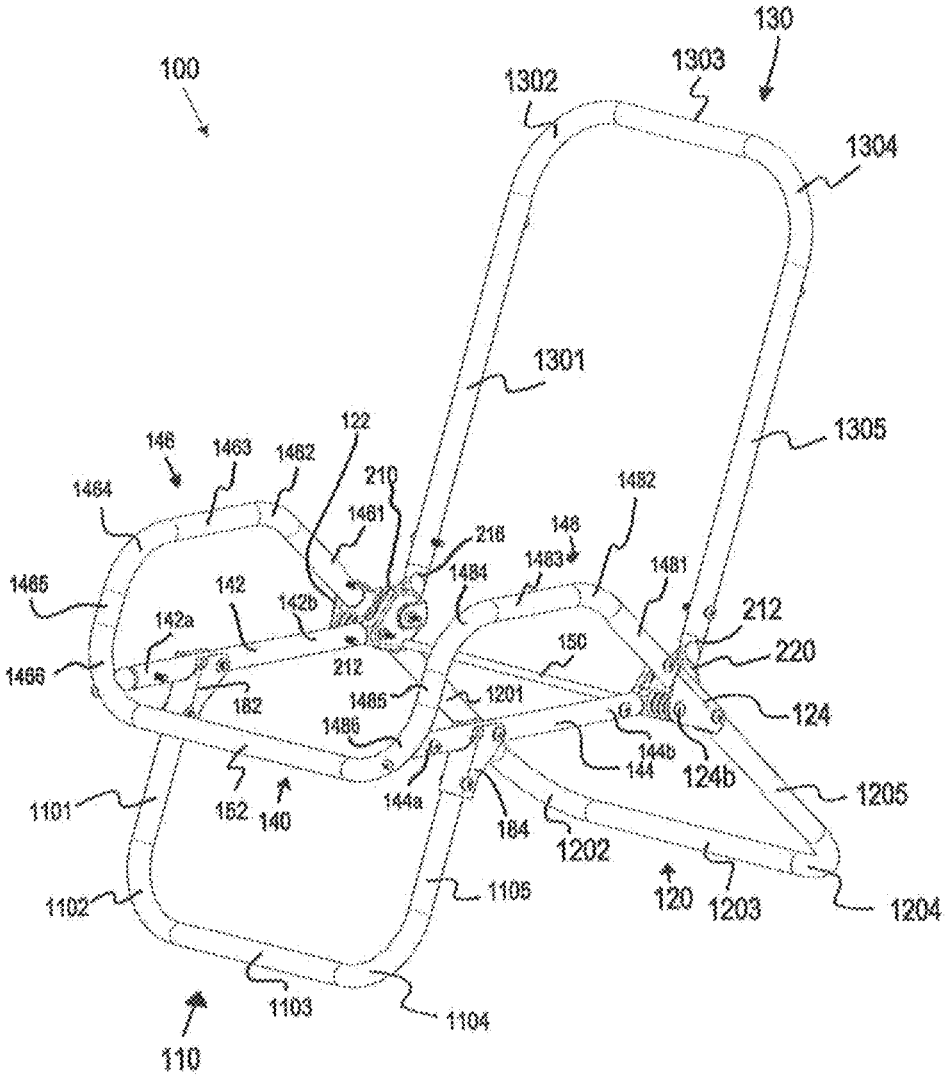
FIG. 2 is a perspective view of a frame assembly of the chair apparatus of FIG. 1.

With reference to FIG. 2, the seat frame 140 of the frame assembly 100 includes a left side frame of the seat frame 142, a right side frame of the seat frame 144, a left armrest 146, and a right armrest 148 extending parallel to each other and parallel to the longitudinal axis X-X (FIG. 4) defined by the seat frame 140. Additionally, the seat frame 140 of the frame assembly 100 includes a rear crossbar 150 and a front crossbar 152 extending parallel to each other and perpendicular to the longitudinal axis X-X defined by the seat frame 140.

The shape of the left armrest 146 and the right armrest 148 may be defined by a plurality of tubes, which are coupled together using any suitable mechanisms, e.g., fasteners, friction fitted, etc. The left armrest 146 may be formed from any number of tubes, which in embodiments, may be a single tube bent into a desired shape. In an exemplary embodiment, the left armrest 146 includes a rear left straight tube 1461, a rear left top radial tube 1462 friction fitted to the rear left straight tube 1461, a left armrest straight tube 1463 friction fitted to the rear left top radial tube 1462, a front left top radial tube 1464 friction fitted to the left armrest straight tube 1463, a front left straight tube 1465 friction fitted to the front left top radial tube 1464, and a front left bottom radial tube 1466 friction fitted to the front left straight tube 1465 and the front crossbar 152. Similarly, the right armrest 148 is defined by a rear right straight tube 1481, a rear right top radial tube 1482 friction fitted to the rear right straight tube 1481, a right armrest straight tube 1483 friction fitted to the rear right top radial tube 1482, a front right top radial tube 1484 friction fitted to the right armrest straight tube 1483, a front right straight tube 1485 friction fitted to the front right top radial tube 1484, and a front right bottom radial tube 1486 friction fitted to the front right straight tube 1485 and the front crossbar 152.

The front left bottom radial tube 1466 is operably coupled to a proximal portion 142*a* of the left side frame of the seat frame 142 and the front right bottom radial tube 1486 is operably coupled to a proximal portion 144*a* of the right side frame of the seat frame 144. In an aspect, the front left bottom radial tube 1466 includes an opening defined therethrough and is secured to an insert (not shown) disposed in the proximal portion 142*a* of the left side frame of the seat frame 142 via a screw passing through the opening and screwed to the insert. Similarly, in an aspect, the front right bottom radial tube 1486 includes an opening defined therethrough and is secured to an insert (not shown) disposed in the proximal portion 144*a* of the right side frame of the seat frame 144 via a screw passing through the opening and screwed to the insert.

When in an open configuration (FIG. 4), the distance "d" of the front crossbar 152 from the ground "G" is smaller than a distance "D" of the left side frame of the seat frame 142 and the right side frame of the seat frame 144 from the ground "G," which serves the dual purpose of providing greater comfort for a user when seated thereon and defining a storage area for the front leg 110 and the rear leg 120 when the front leg 110 and the rear leg 120 are pivoted inward to their stored configurations.

A distal portion 142*b* of the left side frame of the seat frame 142 is coupled to the left hinge assembly 210. In one aspect, a distal portion 142*b* of the left side frame of the seat frame 142 is slid over a left seat finger 212 of the left hinge assembly 210 to fixedly couple the left side frame of the seat frame 142 to the left hinge assembly 210. Additionally, a distal portion of the rear left straight tube 1461 coupled to the left hinge assembly 210. In one aspect, a distal portion of the rear left straight tube 1461 is slid over a left armrest finger 214 of the left hinge assembly 210 to fixedly couple the left armrest 146 to the left hinge assembly 210. Similarly, a distal portion 144*b* of the right side frame of the seat frame 144 is coupled to the right hinge assembly 220. In one aspect, a distal portion 144*b* of the right side frame of the seat frame 144 is slid over a right seat finger 222 of the right hinge assembly 220 to fixedly couple the right side frame of the seat frame 144 to the right hinge assembly 220. A distal portion of the rear right straight tube 1481 is coupled to the right hinge assembly 220. In one aspect, a distal portion of the rear right straight tube 1481 is slid over a right armrest finger 224 of the right hinge assembly 220 to fixedly couple the right armrest 148 to the right hinge assembly 220. The left hinge assembly 210 is directly coupled to the right hinge assembly 220 via the rear crossbar 150 of the seat frame 140. Any of the above-described, or below-described, couplings may be replaced with or supplemented by a screw, a nut and bolt, adhesive, pop-up fasteners, interlocking components, or any combinations thereof.

In one aspect, the left seat finger 212 and the left armrest finger 214 of the left hinge assembly 210 are fixed in position, and non-movable, relative to each other, such that the left side frame of the seat frame 142 is not movable relative to the left armrest 146. Additionally, in one aspect, the right seat finger 222 and the right armrest finger 224 of the right hinge assembly 220 are fixed in position, and non-movable, relative to each other, such that the right side frame of the seat frame 144 is not movable relative to the right armrest 148.

The shape of the front leg 110 is defined by a left straight tube 1101, a left radial tube 1102 friction fitted to the left straight tube 1101, a front leg straight tube 1103 friction fitted to the left radial tube 1102, a right radial tube 1104 friction fitted to the front leg straight tube 1103, and a right straight tube 1105 friction fitted to the right radial tube 1104 to define a U-shaped front leg 110.

The front leg 110 is pivotally coupled to the left side frame of the seat frame 142 via a left front leg hinge 182 and the right side frame of the seat frame 144 via a right front leg hinge 184. A distal end of the left straight tube 1101 is slid into an opening defined by the left front leg hinge 182 and fixedly secured thereto and a distal end of the right straight tube 1105 is slid into an opening defined by the right front leg hinge 184 and fixedly secured thereto. In an aspect, the left front leg hinge 182 is secured to the left side frame of the seat frame 142 at a pivot point located distal the proximal portion 142*a* of the length of the left side frame of the seat frame 142 and the right front leg hinge 184 is secured to the right side frame of the seat frame 144 at a pivot point distal the proximal portion 144*a* of the length of the right side frame of the seat frame 144. Via this pivotable connection, the front leg 110 is movable between an extended configuration, where the front leg 110 is substantially perpendicular to the longitudinal axis X-X of the seat frame 140 (as shown in FIG. 4), and a stored configuration, where the front leg 120 is substantially parallel to the longitudinal axis X-X of the seat frame 140 (as shown in FIG. 5).

The shape of the rear leg 120 is defined by a rear leg left straight tube 1201, a rear leg left radial tube 1202 friction fitted to the rear leg straight tube 1201, a rear leg straight tube 1203 friction fitted to the rear leg left radial tube 1202, a rear leg right radial tube 1204 friction fitted to the rear leg straight tube 1203, and a rear leg right straight tube 1205 friction fitted to the rear leg right radial tube 1204 to define a U-shaped rear leg 120.

The rear leg 120 is pivotally coupled to the left hinge assembly 210 via a left rear leg hinge 122 and the right hinge assembly 220 via a right rear leg hinge 124. Alternatively, the rear leg 120 may be pivotally coupled to any portion of the seat frame 140, via a left rear leg hinge 122 and a right real leg hinge 124, such that the rear leg 120 may pivot about the seat frame 140. A proximal end of the rear leg left straight tube 1201 is slid into an opening defined by the left rear leg hinge 122 and fixedly secured thereto and a proximal end of the rear leg right straight tube 1205 is slid into an opening defined by the right rear leg hinge 124 and fixedly secured thereto. The left rear leg hinge 122 is pivotally coupled to the left hinge assembly 210 (or any other portion of the seat frame 140) via a bolt (not shown) and is pivotable about an axis defined by the bolt. Similarly, the right rear leg hinge 124 is pivotally coupled to the right hinge assembly 220 (or any other portion of the seat frame 140) via bolt 124*b* and is pivotable about an axis defined by bolt 124*b*. Via this connection to the left hinge assembly 210 (or any other portion of the seat frame 140) and the right hinge assembly 220 (or any other portion of the seat frame 140), the rear leg 120 is movable between an extended configuration, where the rear leg 120 is substantially perpendicular to the longitudinal axis X-X of the seat frame 140 (as shown in FIG. 4), and a stored configuration, where the rear leg 120 is substantially parallel to the longitudinal axis X-X of the seat frame 140 (as shown in FIG. 5).

The rear leg 120 has a total inner width that is greater than a total outer width of the front leg 110 so that when the rear leg 120 and the front leg 110 are in their stored configurations (FIG. 5), there exists enough space for front leg 110 to be positioned between rear leg straight tube 1201 and rear leg straight tube 1203.

As best illustrated in FIG. 5, the right armrest 148 and the left armrest 146 are dimensioned such that the left armrest 146 and the right armrest 148 extend beyond an outward face of the storage compartment 500 disposed therebetween to protect the storage compartment 500 (e.g., the outward face of the storage compartment 500) when the chair apparatus 10 is in the folded configuration.

The shape of the back frame 130 is defined by a back frame left straight tube 1301, a back frame left radial tube 1302 friction fitted to the back frame left straight tube 1301, a back frame straight tube 1302 friction fitted to the back frame radial tube 1302, a back frame right radial tube 1304 friction fitted to the back frame straight tube 1303, and a back frame right straight tube 1305 friction fitted to the back frame right radial tube 1304 to define a U-shaped back frame 130.

The back frame 130 is coupled to both of the left hinge assembly 210 and the right hinge assembly 220. In one aspect, a proximal end of the back frame left straight tube 1301 is slid onto the left back finger 216 and fixedly secured thereto and a proximal end of the back frame right straight tube 1305 is slid onto the right back finger 226 and fixedly secured thereto to couple the back frame 130 to the left hinge assembly 210 and the right hinge assembly 220. Via this connection to the left hinge assembly 210 and the right hinge assembly 220, the back frame 130 is movable between an extended configuration, where the back frame 130 is substantially perpendicular to the longitudinal axis X-X of the seat frame 140 (as shown in FIG. 4), a folded configuration, where the back frame 130 is substantially parallel to the longitudinal axis X-X of the seat frame 140 (as shown in FIG. 5), and multiple reclining configurations (including a fully reclined configuration where the back frame lays open parallel to the longitudinal axis X-X of the seat frame 140). In particular, in one aspect, the left back finger 216 is pivotable relative to the left seat finger 212 and the left armrest finger 214 about a pivot point and can be pivoted between a fully folded configuration, where the angle between the left back finger 216 and the left seat finger 214 is smallest, a fully reclined configuration, where the angle between the left back finger 216 and the left seat finger 214 is largest, and multiple reclining angles between the fully folded position and the fully reclined position. Similarly, the right back finger 226 is pivotable relative to the right seat finger 222 and the right armrest finger 224 about a pivot point and can be pivoted between a fully folded configuration, where the angle between the right back finger 226 and the right seat finger 224 is smallest, a fully reclined configuration, where the angle between the right back finger 226 and the right seat finger 224 is largest, and multiple reclining angles between the fully folded position and the fully reclined position.

Figure 6:
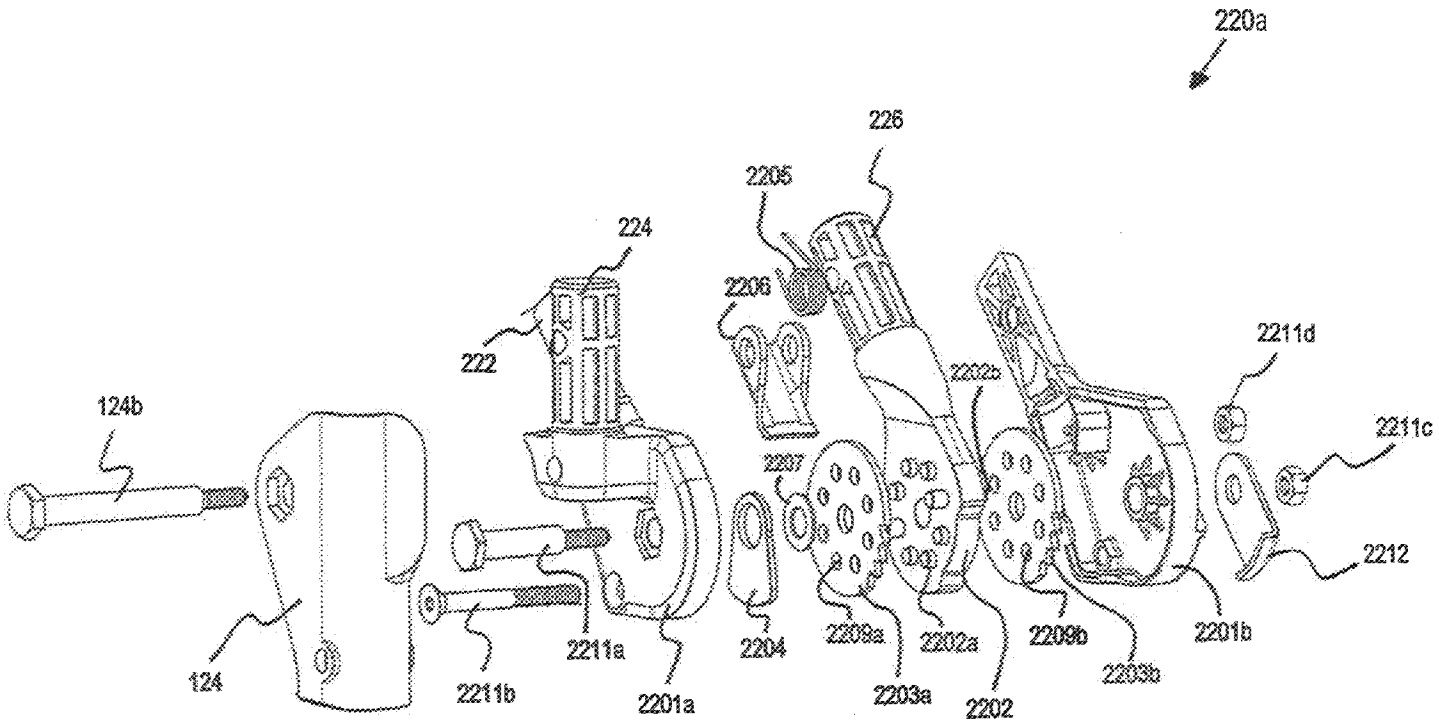
FIG. 6 is an exploded view of an exemplary hinge assembly shown as one aspect of a ratchet assembly of a chair apparatus in accordance with the present disclosure.
Figure 8:
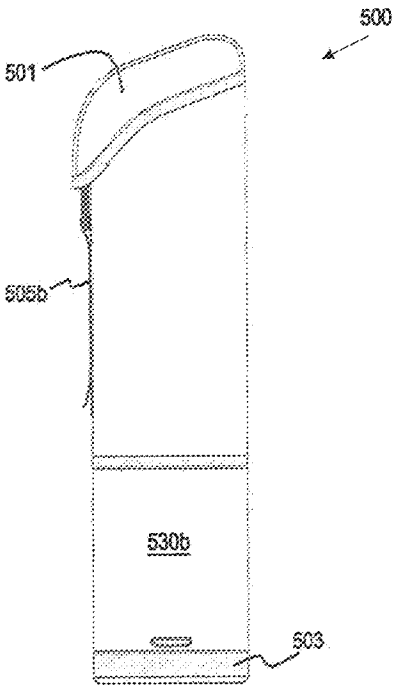
FIG. 8 is a right side view of the storage container of FIG. 7.
Figure 7:
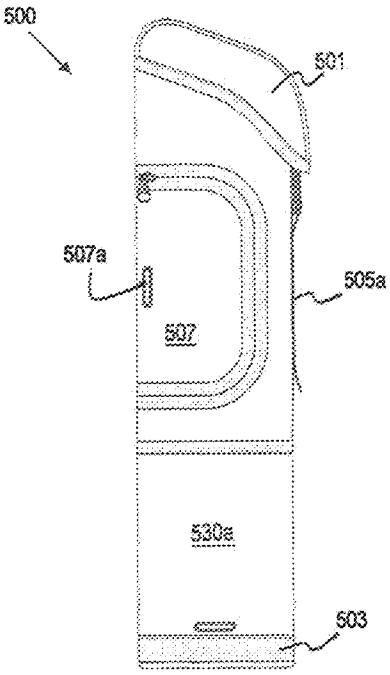
FIG. 7 is a left side view of a storage container of the chair apparatus of FIG. 1, according to the present disclosure.
Figure 9:
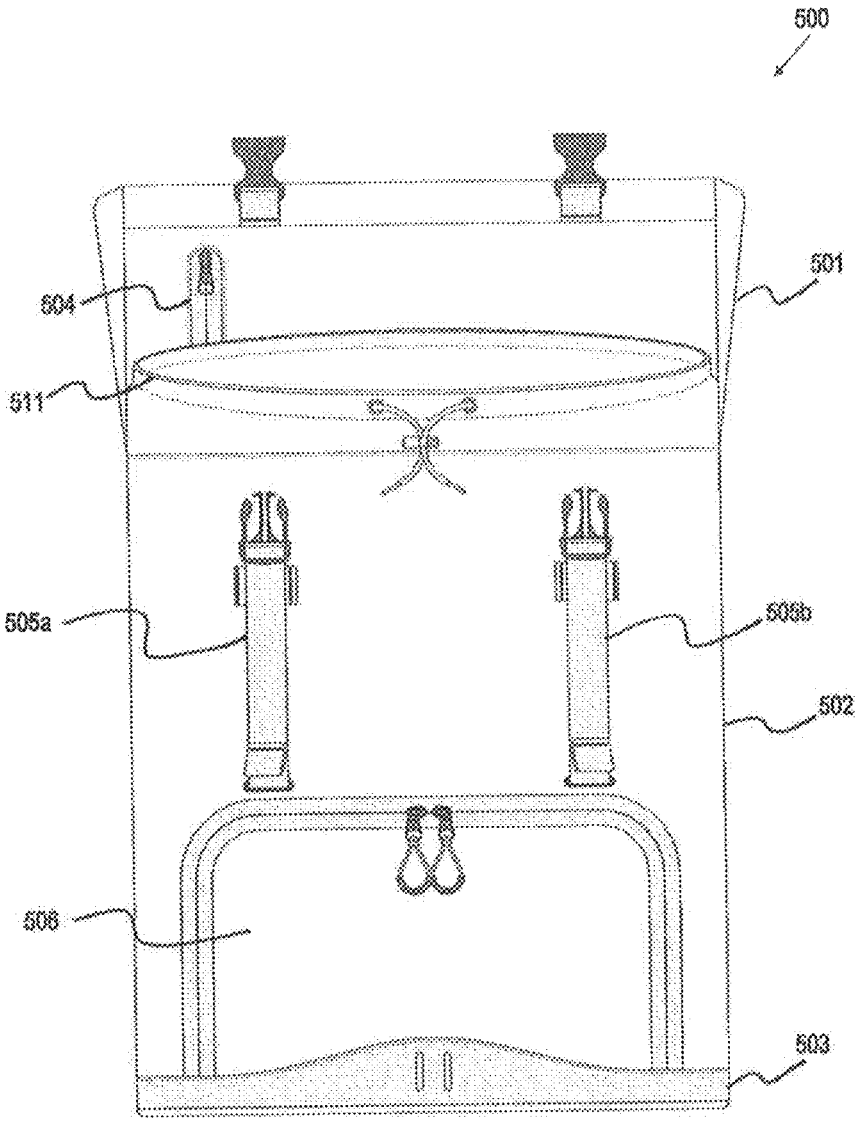
FIG. 9 is a front view of the storage container of FIG. 7 with a lid thereof in an open configuration.

With brief reference to FIG. 6, the components and operation of an exemplary right hinge assembly 220, which is in the form of a ratchet assembly 220*a* will be described. In aspects that utilize a ratchet assembly 220*a* as either the right hinge assembly 220 or the left hinge assembly 210, only a single ratchet assembly could be utilized on one side of the chair apparatus 10 (with the other side having a non-ratchet hinge assembly) or two ratchet assemblies could be utilized. In aspects that utilize two ratchet assemblies, the left ratchet assembly (not shown) includes identical components to those of the right ratchet assembly 220*a* and therefore will not be described for brevity. Right ratchet assembly 220*a* includes housing half 2201*a*, housing half 2201*b*, and a backrest hinge 2202 partially disposed between housing half 2201*a* and housing half 2201*b* and pivotable relative to housing half 2201*a* and housing half 2201*b*. Bolt 2211*a* defines a pivot axis about which backrest hinge 2202 pivots and secures the first housing half 2201*a* to the second housing half 2201*b* when secured by nut 2211*c*. Bolt 2211*b* defines a pivot axis about which stopper 2206 pivots (as biased by resilient member 2205) and also secures the first housing half 2201*a* to the second housing half 2201*b* when secured by nut 221*d*. A shield 2212 is disposed between housing half 2201*b* and nut 221*c* to shield housing half 2201*b* from wear and tear or other damage.

Right backrest finger 226 is cylindrically shaped and extends from backrest hinge 2202 for connection to the back frame 130 and right armrest finger 224 is cylindrical in shape and extends from housing half 2201*a*. Half of right seat finger 222 (semi-cylindrical in shape) extends from housing half 2201*a* while the other half of right seat finger 222 (semi-cylindrical in shape) extends from housing half 2201*b* to define the cylindrical shape of right seat finger 222 when combined. In particular, when housing half 2201*a* and housing half 2201*b* are joined together, the full right seat finger 222 is formed.

Pins 2202*a* are arranged in a circular formation on one side of backrest hinge 2202 and pins 2202*b* are arranged in a circular formation on the other side of backrest hinge 2202. Pins 2202*a* are positioned in respective holes 2209*a* defined by first ratchet disc 2203*a* and pins 2202*b* are positioned in respective holes 2209*b* defined by second ratchet disc 2203*b* such that pivotal movement of backrest hinge 2202 about the pivot axis defined by bolt 2211*a* causes corresponding pivotal movement of each of first ratchet disc 2203*a* and second ratchet disc 2203*b*. The right outer top pin and the right outer bottom pin of respective pins 2202*a* and pins 2202*b* extend further in distance from the respective side of backrest hinge 2202 than the other six pins of pins 2202*a* and pins 2202*b* such that the right outer top pin and the right outer bottom pin of respective pins 2202*a* and pins 2202*b* protrude from the respective holes 2209*a* and the respective holes 2209*b*. The protrusion of these pins is for the purpose of constraining the recliner reset 2204 between them such that when a protruding pin contacts a side of recliner reset 2204 via pivotal movement of backrest hinge 2202, the continued movement of the backrest hinge 2202 causes corresponding pivotal movement of the recliner reset 2204.

It is envisioned that hinge assembly 210 and/or hinge assembly 220 may include some, all, or none of the components of the ratchet assembly 220*a* described above with respect to FIG. 6. For example, in one aspect, hinge assembly 210 and/or hinge assembly 220 may include some or all of fingers 222, 224, 226 or similar components to secure the hinge assemblies 210, 220 to the components of the frame assembly 110 (e.g., seat frame 140, back frame 130, etc.).

Turning back to frame assembly 100, back frame 130 of frame assembly 100 includes a rivet 15 (FIG. 1) protruding therefrom and configured to mate with a latch 16 extending from a portion of the seat frame 140 to retain the chair apparatus 10 in the folded configuration. In an aspect, back frame 130 includes multiple rivets 15 and seat frame includes multiple corresponding latches 16. Although illustrated and described as the back frame 130 including a rivet 15 and the seat portion 140 including a latch 16, the back frame 130 may include a latch 16 and the seat portion 140 may include a rivet 15, or combinations thereof.

Figure 3:
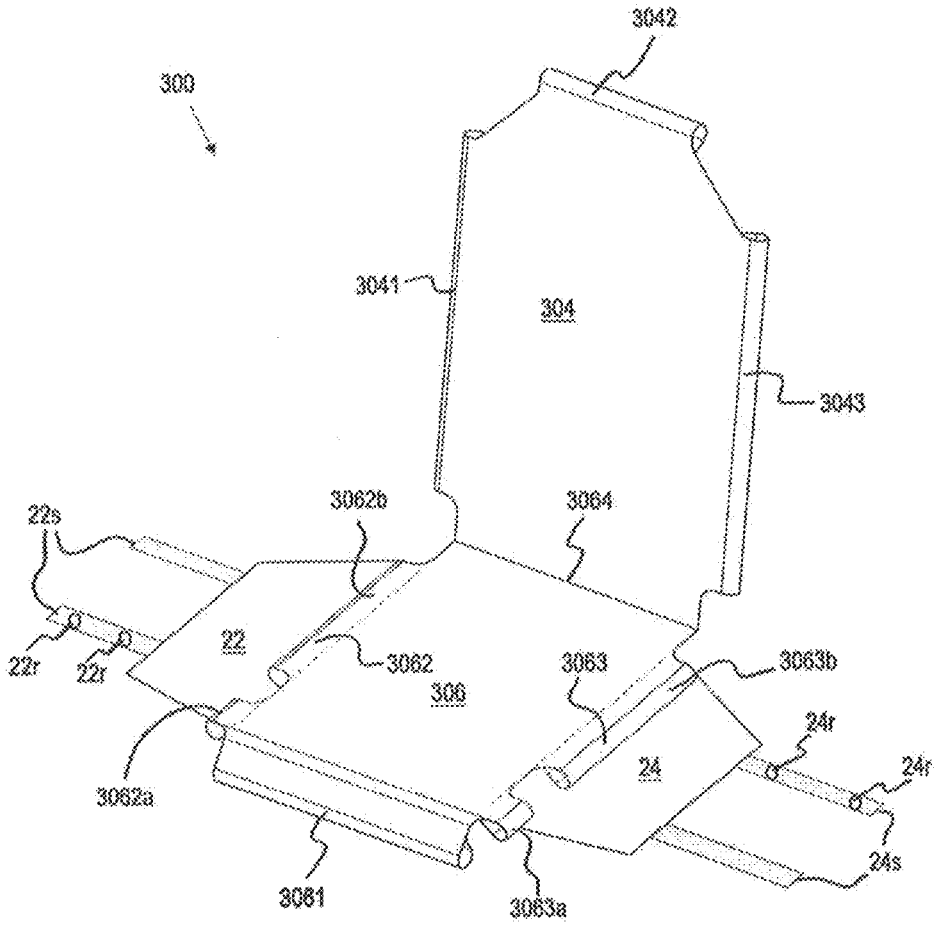
FIG. 3 is a perspective view of a fabric of the chair apparatus of FIG. 1.

The chair apparatus 10 includes a fabric 300 wrapped around portions of the frame assembly 100 and configured to support a user seated thereon. As shown in FIG. 3, the fabric 300 is a single piece of fabric, however it is contemplated that the fabric 300 may be several, connected, pieces of fabric. The fabric 300 includes a back portion 304 coupled to the back frame 130 of the frame assembly 100, a seat portion 306 coupled to the seat frame 140 of the frame assembly 100, and side tables 22 and 24 extending therefrom and coupled to left armrest 146 and right armrest 148, respectively. In particular, the back portion 304 of the fabric 300 includes a left back loop 3041, which wraps around a length of the back frame left straight tube 1301, a top back loop 3042, which wraps around a length of the back frame straight tube 1303, and a right back loop 3043 which wraps around a length of the back frame right straight tube 1305. Additionally, the seat portion 306 of the fabric 300 includes a proximal seat loop 3061, which wraps around a length of the front crossbar 152, a left seat loop 3062, which wraps around a length of the left side frame of the seat frame 142, a rear seat loop 3064, which wraps around a length of the rear crossbar 150, and a right seat loop 3063 which wraps around a length of the right side frame of the seat frame 144.

In an aspect, the left seat loop 3062 is divided into a proximal left seat loop 3062*a*, which wraps around the proximal portion 142*a* of the left side frame of the seat frame 142, proximal the left front leg hinge 182, and a distal left seat loop 3062*b*, which wraps around the distal portion 142*b* of the left side frame of the seat frame 142, distal the left front leg hinge 182, and defines a gap between the proximal seat loop 3062*a* and the distal seat loop 3062*b* for which the left front leg hinge is 182 to be positioned. Additionally, in and aspect, the right seat loop 3063 is divided into a proximal right seat loop 3063*a*, which wraps around the proximal portion 144*a* of the right side frame of the seat frame 144, proximal the right front leg hinge 184, and a distal right seat loop 3063*b*, which wraps around the distal portion 144*b* of the right side frame of the seat frame 144, distal the right front leg hinge 184, and defines a gap between the proximal seat loop 3063*a* and the distal seat loop 3063*b* for which the right front leg hinge 184 is to be positioned.

Fabric 300 further defines a left side table 22 and a right side table 24 extending from opposite sides of the seat portion 306 and pivotable relative to the seat portion 306. The left side table 22 includes straps 22*s* which operably couple the left side table 22 to the left armrest 146 (or padding material 346 wrapped around the left armrest 146). Similarly, the right side table 24 includes straps 24*s* which operably couple the right side table 24 to the right armrest 148 (or padding material 348 wrapped around the right armrest 148). The left side table 22 and the right side table 24 are movable between a stored configuration (as shown in FIG. 5), where the left side table 22 and right side table 24 are facing the left armrest 146 and the right armrest 148, respectively, and an open, flat, configuration (as shown in FIG. 1), where the left side table 22 and the right side table 24 lay flat to support an object placed thereon. Each of straps 22*s* include at least two retainers 22*r* disposed along a length thereof and each of the retainers 22*r* are positioned relative to each other on the same strap 22*s* such that the two retainers 22*r* mate with each other when side table 22 is placed in the stored configuration to retain side table 22 in the stored configuration. Similarly, each of straps 24*s* include at least two retainers 24*r* disposed along a length thereof and each of the retainers 24*r* are positioned relative to each other on the same strap 24*s* such that the two retainers 24*r* mate with each other when side table 24 is placed in the stored configuration to retain side table 24 in the stored configuration. Retainers 22*r* and retainers 24*r* may be, for example, snap fitting components, hook and loop and fasteners, magnetic components, or any combinations thereof.

In an aspect, either or both of the left side table 22 or the right side table 24 includes an opening or drop-down, collapsible, holder "H" (FIG. 1). The drop-down holder "H" may be held in place in a collapsed configuration, against a bottom-side of the side table 22 or side table 24, by any suitable means, for example, by magnetic retaining elements, hook and loop fasteners, snap fitting components, or any combinations thereof. The holder "H" may have any suitable shape for retaining items therein. For example, the holder "H" may have a circular cross-section for retaining a cup, bottle, or other cylindrical item therein. Alternatively, the holder "H" may have a rectangular cross-section for retaining an electronic device such as a cell phone or tablet therein.

Additionally, or alternatively, either or both of the left side table 22 or the right side table 24 may include a clear plastic sleeve disposed along its length to retain an electronic device in such a manner that a display of the electronic device is viewable by a user seated in the chair. In an aspect, the clear plastic sleeve may be detachable from the left side table 22 and/or the right side table 24. Additionally, or alternatively, either or both of left side table 22 or right side table 24 may be detachable from some or all of the remaining portions of fabric 300. For example, any of the plastic sleeve, the left side table 22, or the right side table 24 may be detached from fabric 300 while still being fixedly coupled to left armrest 146 (or padding material 346 coupled thereto) or right armrest 128 (or padding material 348 coupled thereto), via one of straps 22*s* or 24*s*, or any other suitable means, for example, additional straps or chain links.

In an aspect, either or both of the left side table 22 or the right side table 24 includes a speaker "S" (FIG. 1) associated therewith which is configured to connect to an electronic device via wireless or wired connection. The speaker "S" may be coplanar with a top surface of the left side table 22 or the right side table 24, such that when the left side table 22 or the right side table 24 are in the open configuration, the speaker "S" is facing upward in the direction of the user seated on the apparatus 10. Additionally, with this coplanar configuration, when the left side table 22 or the right side table 24 are in the stored (e.g., closed) configuration, the speaker "S" associated therewith is inwardly-facing and protected from exposure to potential damage.

Additionally, either or both of the left side table 22 or the right side table 24 includes a charging device "C" (FIG. 1) associated therewith which is configured to connect to an electronic device via wireless or wired connection to charge an electronic device connected thereto. For example, in one aspect, charging device "C" is a wireless charging device which is coupled to a separate power supply (e.g., a battery, solar cell, combined battery and solar cell, etc.) which can be coupled to the side table or another portion of the apparatus 10, for example, the storage compartment 500. In one configuration, the charging device "C" is coplanar with the top surface of the left side table 22 or the right side table 24, such that when the side table is in the open (e.g. flat) configuration (FIG. 1) a user may simply place a wirelessly-chargeable electronic device on the side table to initiate charging of the electronic device placed thereon by the charging device "C". In an aspect, the charging device "C" is associated with the holder "H" such that when an electronic device is positioned within the holder "H" a wired or wireless connection is made between the electronic device and the charging device "C" to initiate charging of the electronic device (and in some configurations to initiate a connection between the electronic device and other components of the apparatus 10, for example, speaker "S").

Either or both of the left side table 22 or the right side table 24 may include at least one solar cell "SC" (FIG. 1) as a power supply, or coupled to a power supply, which is configured to generate, store, and/or supply power to any of the components of the apparatus (e.g., charging device "C", speaker "S", etc.) or components attached to, or associated with, the apparatus 10, for example an electronic device supported by either or both of left side table 22 or right side table 24. The solar cell "SC" may be coplanar with a top surface of the left side table 22 or the right side table 24, such that when the left side table 22 or the right side table 24 are in the open configuration, the solar cell "SC" is facing upward for maximum exposure to the sun. Additionally, with this coplanar configuration, when the left side table 22 or the right side table 24 are in the stored (e.g., closed) configuration, the solar cell "SC" associated therewith is inwardly-facing and protected from exposure to potential damage and dirt accumulation which could reduce performance of the solar cell "C".

The bottom-side of seat portion 306 of fabric 300 includes two shoulder straps 410, 420 coupled thereto and configured to enable a user to wear the chair apparatus 10 when it is in the folded configuration. In particular, a proximal portion of shoulder strap 410 is sewn to a proximal portion of the bottom-side of the seat portion 306, proximate the proximal seat loop 3061 of fabric 300, and a distal portion of shoulder strap 410 is sewn to a distal portion of the bottom-side of the seat portion 306, proximate the rear seat loop 3064 of fabric 300. Similarly, a proximal portion of shoulder strap 420 is sewn to a proximal portion of the bottom-side of the seat portion 306, proximate the proximal seat loop 3061 of fabric 300, and a distal portion of shoulder strap 420 is sewn to a distal portion of the bottom-side of the seat portion 306, proximate the rear seat loop 3064 of fabric 300. Additionally, or alternatively, the shoulder straps 410, 420 may be coupled directly to the frame assembly 100.

A back-side of the back portion 304 of fabric 300 includes a storage compartment 500 operably coupled thereto. In one aspect, the storage compartment 500 is sewn to the back-side of the back portion 304 of fabric 300. Additionally, or alternatively, storage compartment 500 may be directly coupled to back frame 130. In an aspect, the storage compartment 500 is removably coupled to the fabric 300 of the back frame 130, such that a user may remove and reattached the storage compartment 500 thereto. Additionally, the storage comportment 500 is positioned on the back-side of the back portion 304 of fabric 300 such that when the back frame 130 is in the folded configuration (as shown in FIG. 5), the storage compartment 500 is at least partially disposed between the left armrest 146 and the right armrest 148. Being at least partially disposed between the left armrest 146 and the right armrest 148 affords the storage compartment 500, and objects stored therein, protection from damage.

With reference to FIGS. 7-10, storage compartment 500 will now be described in detail. Storage compartment 500 may be formed of any suitable material or combinations of materials. In one aspect, storage compartment 500 is a soft shell formed of the same material as fabric 300. Storage compartment 500 includes a base section 502 and a lid 501 hingedly coupled to the base section 502 at a backside of the storage compartment 500. Lid 501 defines a lid pocket 504 therein for storage of objects within the lid 501 itself. Male ends of buckle 505*a* and buckle 505*b* are sewn to a portion of base section 502 and female ends of buckle 505*a* and buckle 505*b* are sewn to lid 501. In an aspect, straps of buckles 505*a*, 505*b* are sewn to an interior portion of storage compartment 500 after being passed therethrough from an exterior of the storage compartment 500. Additionally, or alternatively, storage compartment 500 may include a drawstring opening at a top portion thereof. The bottom portion of base section 502 is lined with protective base 503, which may be formed of material including for example, leather, fabric, metals, or any other protective rigid or semi-rigid material.

An elastic side pocket 530*a* and an elastic side pocket 530*b* are disposed on respective sides of the base section 502. Additionally, at least one side of the base section 502 includes a wet pocket 507 secured by a zipper and having an opening defined therethrough for the passage of air 507*a* therein. The wet pocket 507 is lined with a waterproof and/or moisture impervious material, material so that that water or moisture does not pass through to the remaining portions of the storage compartment 500.

Figure 10:
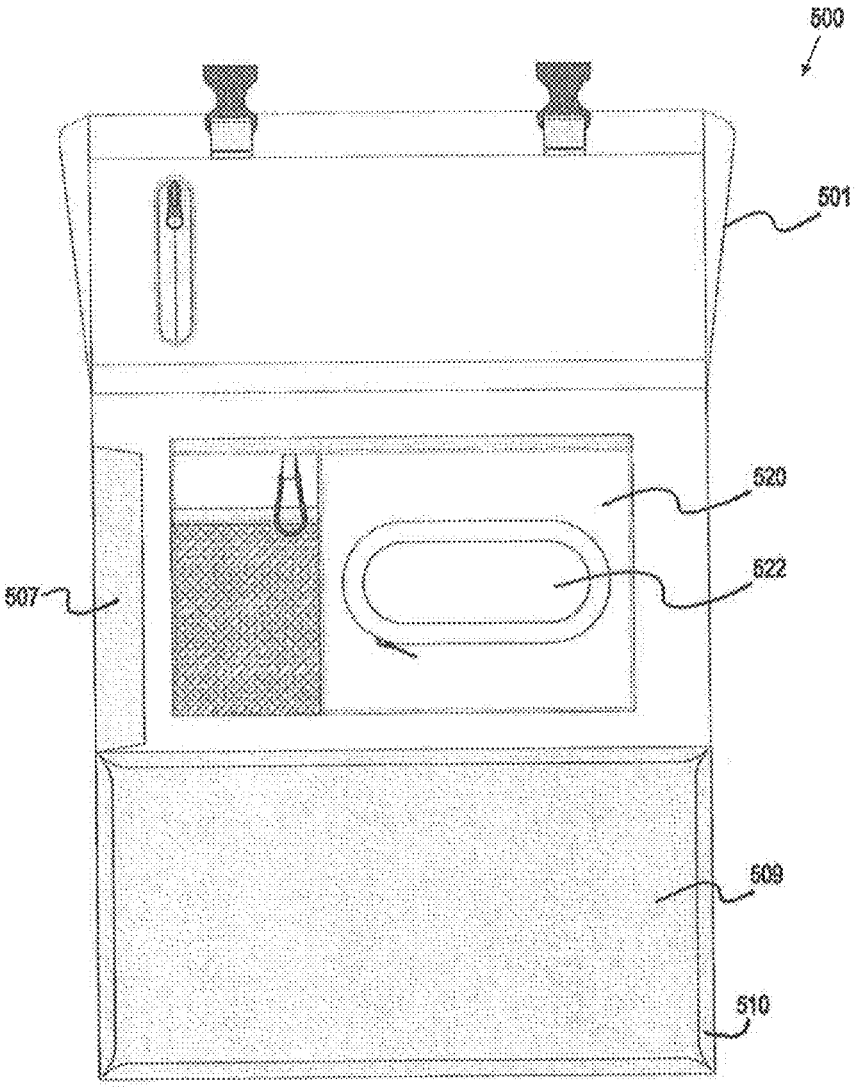
FIG. 10 is a front, cross-sectional, view of an interior portion of the storage container of FIG. 7.

A cooler pocket 509 is defined in the lower portion of the base section 502 and is lined with a waterproof and/or moisture impervious material and insulated walls 510 (FIG. 10). Additionally, either or both of the back side or the front side of the interior of the storage compartment 500 includes an elastic wall pocket 520 with a rigid-shell case 522 for storage of fragile objects. The rigid-shell case 522 is removably coupled to a portion of the storage compartment 500.

Although aspects have been described in detail with reference to the accompanying drawings for the purpose of illustration and description, it is to be understood that the inventive processes and apparatus are not to be construed as limited thereby. It will be apparent to those of ordinary skill in the art that various modifications to the foregoing aspects may be made without departing from the scope of the disclosure.

What is claimed:

1. A combined foldable chair and backpack apparatus comprising:

a frame assembly including:

a left hinge assembly and a right hinge assembly;

a seat frame having:

a left side frame of the seat frame operably coupled to the left hinge assembly;

a right side frame of the seat frame operably coupled to the right hinge assembly;

a left armrest operably coupled to the left hinge assembly;

a right armrest operably coupled to the right hinge assembly;

a rear crossbar operably coupled to the right hinge assembly and the left hinge assembly; and a front crossbar operably coupled to the left armrest and the right armrest;

a front leg operably coupled to and extending from the left side frame of the seat frame and the right side frame of the seat frame such that the front leg is movable between an extended configuration, in which the front leg is substantially perpendicular to a longitudinal axis of the seat frame, and a stored configuration, in which the front leg is substantially parallel to the longitudinal axis of the seat frame;

a rear leg operably coupled to and extending from the left hinge assembly and the right hinge assembly such that the rear leg is movable between an extended configuration, in which the rear leg is substantially perpendicular to the longitudinal axis of the seat frame, and a stored configuration, in which the rear leg is substantially parallel to the longitudinal axis of the seat frame; and a back frame operably coupled to and extending from the left hinge assembly and the right hinge assembly such that the back frame is movable between an extended configuration, in which the back frame is substantially perpendicular to the longitudinal axis of the seat frame, and a folded configuration, in which the back frame is substantially parallel to the longitudinal axis of the seat frame;

a fabric having a seat portion operably coupled to the seat frame and a back portion operably coupled to the back frame and configured to support a user seated thereon;

a shoulder strap operably coupled to at least one of the fabric or the seat frame; and a storage compartment operably coupled to at least one of the back frame of the frame assembly or the back portion of the fabric.

2. The combined foldable chair and backpack of claim 1, wherein the frame assembly further includes a left front leg hinge and a right front leg hinge pivotally coupling the front leg to the seat frame.

3. The combined foldable chair and backpack of claim 2, wherein the front leg forms a U-shape defined by:

a front leg left straight tube operably coupled to the left front leg hinge;

a front leg left radial tube operably coupled to the front leg left straight tube;

a front leg straight tube operably coupled to the front leg left radial tube;

a front leg right radial tube operably coupled to the front leg straight tube; and a front leg right straight tube operably coupled to the front leg right radial tube and the right front leg hinge.

4. The combined foldable chair and backpack of claim 1, wherein the frame assembly further comprises a left rear leg hinge and a right rear leg hinge pivotally coupling the rear leg to the right hinge assembly.

5. The combined foldable chair and backpack of claim 4, wherein the rear leg forms a U-shape defined by:

a rear leg left straight tube operably coupled to the left rear leg hinge;

a rear leg left radial tube operably coupled to the rear leg left straight tube;

a rear leg straight tube operably coupled to the rear leg left radial tube;

a rear leg right radial tube operably coupled to the rear leg straight tube; and a rear leg right straight tube operably coupled to the rear leg right radial tube and the right rear leg hinge.

6. The combined foldable chair and backpack of claim 1, wherein the front crossbar, the left armrest, and the right armrest are formed of a single tubular frame.

7. The combined foldable chair and backpack of claim 1, wherein the left armrest includes:

a rear left straight tube operably coupled to a left armrest finger of the left hinge assembly;

a rear left top radial tube operably coupled to the rear left straight tube;

a left armrest straight tube operably coupled to the rear left top radial tube;

a front left top radial tube operably coupled to the left armrest straight tube;

a front left straight tube operably coupled to the front left top radial tube; and a front left bottom radial tube operably coupled to the front left straight tube and the front crossbar.

8. The combined foldable chair and backpack of claim 7, wherein the front left bottom radial tube is operably coupled to a proximal portion of the left side frame of the seat frame and a front right bottom radial tube is operably coupled to a proximal portion of the right side frame of the seat frame.

9. The combined foldable chair and backpack of claim 1, wherein the right armrest and the left armrest are dimensioned such that the left armrest and the right armrest extend beyond an outward face of the storage compartment disposed therebetween to protect the storage compartment.

10. The combined foldable chair and backpack of claim 1, wherein the back frame includes:

a back frame left straight tube operably coupled to a left back finger of the left hinge assembly;

a back frame left radial tube operably coupled to the back frame left straight tube;

a back frame straight tube operably coupled to the back frame left radial tube;

a back frame right radial tube operably coupled to the back frame straight tube; and a back frame right straight tube operably coupled to the back frame right radial tube and a right back finger of the right hinge assembly.

11. The combined foldable chair and backpack of claim 1, further comprising a latch extending from the front crossbar of the seat frame and configured to secure the front crossbar to the back frame when the back frame is in the folded configuration.

12. The combined foldable chair and backpack of claim 1, wherein the left armrest and the right armrest are tubular and are surrounded by a padding material.

13. The combined foldable chair and backpack of claim 1, further comprising a side table operably coupled to the seat portion of the fabric and the left armrest, the side table configured to move between a closed configuration, where the side table is folded inwardly toward the left armrest, and an open configuration, where the side table lays flat to support an object thereon.

14. The combined foldable chair and backpack of claim 13, wherein one end of the side table extends from the seat portion of the fabric and a second end of the side table is coupled to the left armrest by at least one strap.

15. The combined foldable chair and backpack of claim 13, wherein the side table includes at least one retaining element configured to retain the side table in the closed configuration.

16. The combined foldable chair and backpack of claim 13, further comprising at least one of a solar cell, an energy storage device, or a charging device operably coupled to the side table, such that at least one of the solar cell, the energy storage device, or the charging device is protected from damage when the side table is in the closed configuration.

17. The combined foldable chair and backpack of claim 13, further comprising a speaker operably coupled to the side table and coplanar therewith, such that the speaker is protected from damage when the side table is in the folded configuration.

18. The combined foldable chair and backpack of claim 1, wherein the fabric defines:

a proximal left seat loop coupled to a proximal portion of the left side frame of the seat frame;

a distal left seat loop coupled to a distal portion of the left side frame of the seat frame;

a gap between the proximal left seat loop and the distal left seat loop;

a proximal right seat loop coupled to a proximal portion of the right side frame of the seat frame:

a distal right seat loop coupled to a distal portion of the right side frame of the seat frame; and a gap between the proximal right seat loop and the distal right seat loop.

19. The combined foldable chair and backpack of claim 1, further comprising a rigid case removably coupled to a portion of the storage compartment.

20. The combined foldable chair and backpack of claim 1, wherein an inner width of the rear leg is greater than an outer width of the front leg.

* * * * *